US006777920B2

(12) United States Patent
Furutani et al.

(10) Patent No.: US 6,777,920 B2
(45) Date of Patent: Aug. 17, 2004

(54) INTERNAL POWER-SUPPLY POTENTIAL GENERATING CIRCUIT

(75) Inventors: Kiyohiro Furutani, Hyogo (JP); Takeshi Hamamoto, Hyogo (JP); Susumu Tanida, Hyogo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/247,337

(22) Filed: Sep. 20, 2002

(65) Prior Publication Data

US 2003/0184267 A1 Oct. 2, 2003

(30) Foreign Application Priority Data

Mar. 27, 2002 (JP) ..... 2002-088609

(51) Int. Cl.[7] ..... G05F 1/40

(52) U.S. Cl. ..... 323/280; 323/281; 327/540; 327/541

(58) Field of Search ..... 323/266, 268, 323/280, 281, 274, 275; 327/319, 333, 540, 541, 316, 537, 308, 535, 534, 538, 530, 542; 365/195, 233, 226, 228; 307/296.1, 296.3

(56) References Cited

U.S. PATENT DOCUMENTS 5,249,155 A * 9/1993 Arimoto et al. ..... 365/222

6,011,428 A * 1/2000 Tsukude et al. ..... 327/541

FOREIGN PATENT DOCUMENTS

JP 2001-216035 8/2001

* cited by examiner

*Primary Examiner*—Rajnikant B. Patel
(74) *Attorney, Agent, or Firm*—McDermott Will & Emery LLP

(57) ABSTRACT

The internal power-supply potential generating circuit includes a reference potential generating circuit having small dependency on an external power-supply potential and on a temperature, an MOS transistor for pull up, a level shifter producing a potential lower than a reference potential by a prescribed voltage to a first node and producing a potential lower than an internal power-supply potential by a voltage of the sum of the prescribed potential and an offset potential to a second node, and a differential amplifier bringing an MOS transistor out of conduction in response to the potential of the second node reaching the potential of the first node. Thus, the reference potential may be set lower by the offset voltage, allowing stable reference potential and internal power-supply potential to be obtained even if the external power-supply potential is lowered.

5 Claims, 5 Drawing Sheets

INTERNAL POWER-SUPPLY POTENTIAL GENERATING CIRCUIT

BACKGROUND OF THE INVENTION

1. Field of the Invention

The present invention relates to an internal power-supply potential generating circuit, and more particularly, to an internal power-supply potential generating circuit that generates an internal power-supply potential based on an external power-supply potential.

2. Description of the Background Art

In a semiconductor memory device, reduction of power consumption has conventionally been attempted by operating an internal circuit with an internal power-supply potential intVCC that is lower than an external power-supply potential VCC. Thus, a semiconductor memory device is provided with an internal power-supply potential generating circuit that down-converts external power-supply potential VCC to generate internal power-supply potential intVCC. FIG. 8 shows a circuit diagram illustrating the configuration of such an internal power-supply potential generating circuit.

In FIG. 8, the internal power-supply potential generating circuit includes a reference potential generating circuit 50, a differential amplifier 53 and a P-channel MOS transistor 54. Reference potential generating circuit 50 includes a constant-current source 51 and a resistive element 52 connected in series between the line of external power-supply potential VCC and the line of a ground potential VSS. A-reference potential VR appears at a node N51 between constant-current source 51 and resistive element 52. P-channel MOS transistor 54 is connected between the line of external power-supply potential VCC and a power-supply node N54. The potential appearing at power-supply node N54 comes to be internal power-supply potential intVCC. Differential amplifier 53 has an inverting input terminal that receives reference potential VR, a noninverting input terminal that receives internal power-supply potential intVCC, and an output terminal connected to the gate of P-channel MOS transistor 54. Differential amplifier 53 and P-channel MOS transistor 54 constitute a voltage follower.

If internal power-supply potential intVCC is lower than reference potential VR, differential amplifier 53 outputs a signal at a logic low or "L" level to bring P-channel MOS transistor 54 into conduction. If internal power-supply potential intVCC is higher than reference potential VR, differential amplifier 53 outputs a signal at a logic high or "H" level to bring P-channel MOS transistor 54 out of conduction. Accordingly, internal power-supply potential intVCC is held at the same potential as reference potential VR.

It is required for a semiconductor memory device having external power-supply potential VCC of 2.5V to ensure normal operation even if external power-supply potential VCC varies in the range of 2.5V±0.2V. The semiconductor memory device having external power-supply potential VCC of 2.5V therefore requires a margin to set internal power-supply potential intVCC at 2.2V.

In internal power-supply potential generating circuit in FIG. 8, however, voltage drop of 0.2V occurs at constant-current source 51, which causes reference potential VR to be lower than 2.2V when external power-supply potential VCC is lowered to less than 2.4V. This makes it impossible to hold internal power-supply potential intVCC at 2.2V.

Moreover, output current of constant-current source 51 increases in proportional to temperature, so that reference potential VR is increased as the temperature increases, making internal power-supply potential intVCC higher than 2.2V.

SUMMARY OF THE INVENTION

A primary object of the present invention is, therefore, to provide an internal power-supply potential generating circuit that can generate a stable internal power-supply potential.

According to an aspect of the present invention, an internal power-supply potential generating circuit includes a switching element connected between a line of an external power-supply potential and a line of an internal power-supply potential, a reference potential generating circuit generating a predetermined first reference potential, a level shift circuit having a predetermined offset voltage and generating a second reference potential lower than the first reference potential by a predetermined voltage while generating a monitoring potential lower than the internal power-supply potential by a voltage obtained by adding the offset voltage to the predetermined voltage, and a differential amplifier bringing the switching element into conduction when the monitoring potential is lower than the second reference potential and bringing the switching element out of conduction when the monitoring potential is higher than the second reference potential. Accordingly, the internal power-supply potential is held at a potential obtained by adding the offset voltage to the first reference potential, allowing the first reference potential to be set lower by the offset voltage. Thus, even if the external power-supply potential is lowered, the first reference potential is not lowered, enabling generation of a stable internal power-supply potential. Moreover, the differential amplifier may be operated in a region with a large gain, so that responsibility to variation in the internal power-supply potential is improved.

According to another aspect of the present invention, an internal power-supply potential generating circuit includes a switching element connected between a line of the external power-supply potential and a line of the internal power-supply potential, a first voltage dividing circuit having a first voltage division ratio and generating a monitoring potential by dividing the internal power-supply potential, a reference potential generating circuit generating a predetermined first reference potential, a second voltage dividing circuit having a second voltage division ratio higher than the first voltage division ratio and generating a second reference potential by dividing the first reference potential, and a differential amplifier bringing the switching element into conduction when the monitoring potential is lower than the second reference potential and bringing the switching element out of conduction when the monitoring potential is higher than the second reference potential. Accordingly, the monitoring potential obtained by dividing the internal power-supply potential at the first voltage division ratio is held at the second reference potential obtained by dividing the first reference potential at a second voltage division ratio higher than the first division ratio, allowing the first reference potential to be set lower by the difference between the first and second voltage division ratios. Thus, even if the external power-supply potential is lowered, the first reference potential is not lowered, enabling generation of a stable internal power-supply potential.

DESCRIPTION OF THE PREFERRED EMBODIMENTS

Fist Embodiment

Figure 1:
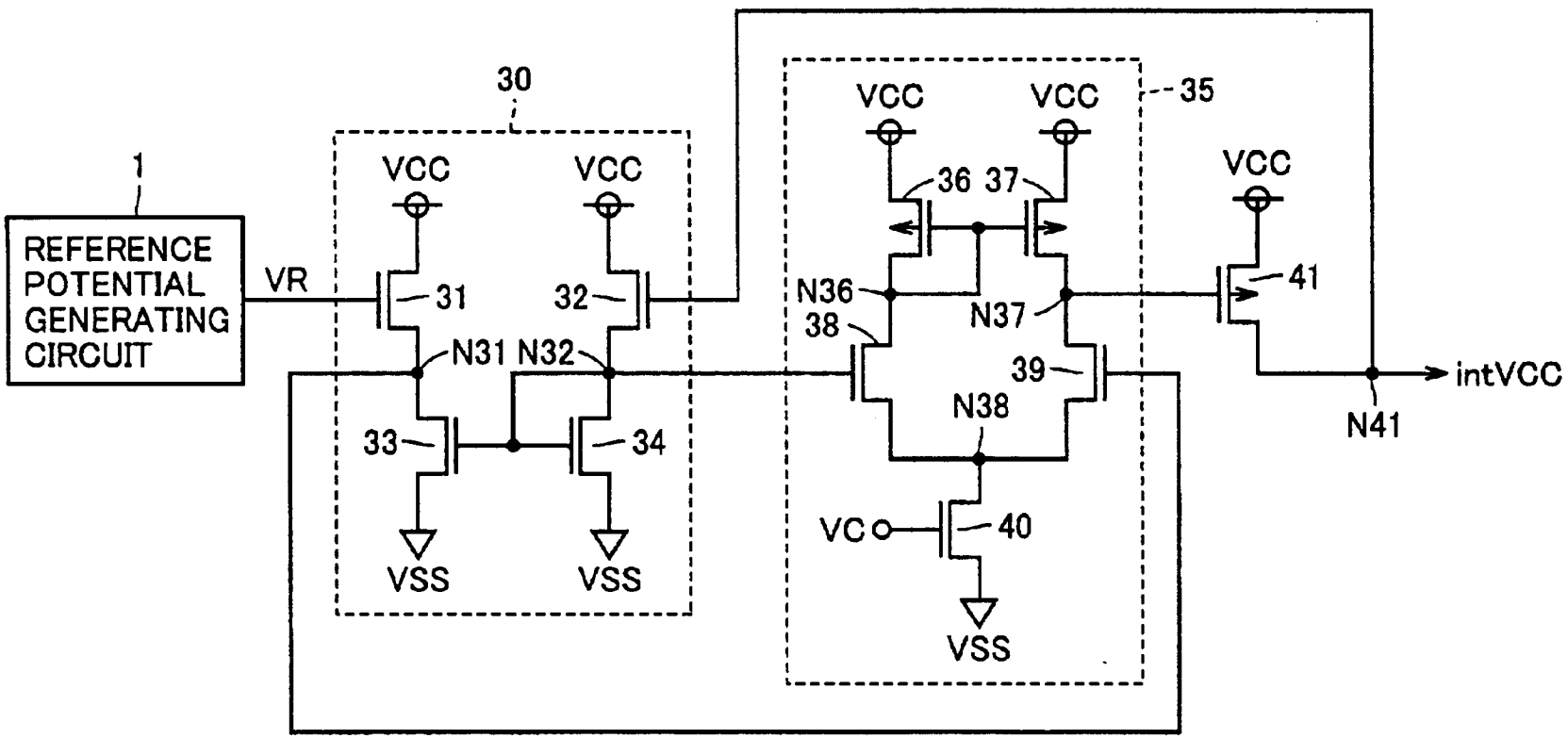
FIG. 1 is a circuit diagram showing the configuration of an internal power-supply potential generating circuit according to the first embodiment of the present invention.
Figure 2:
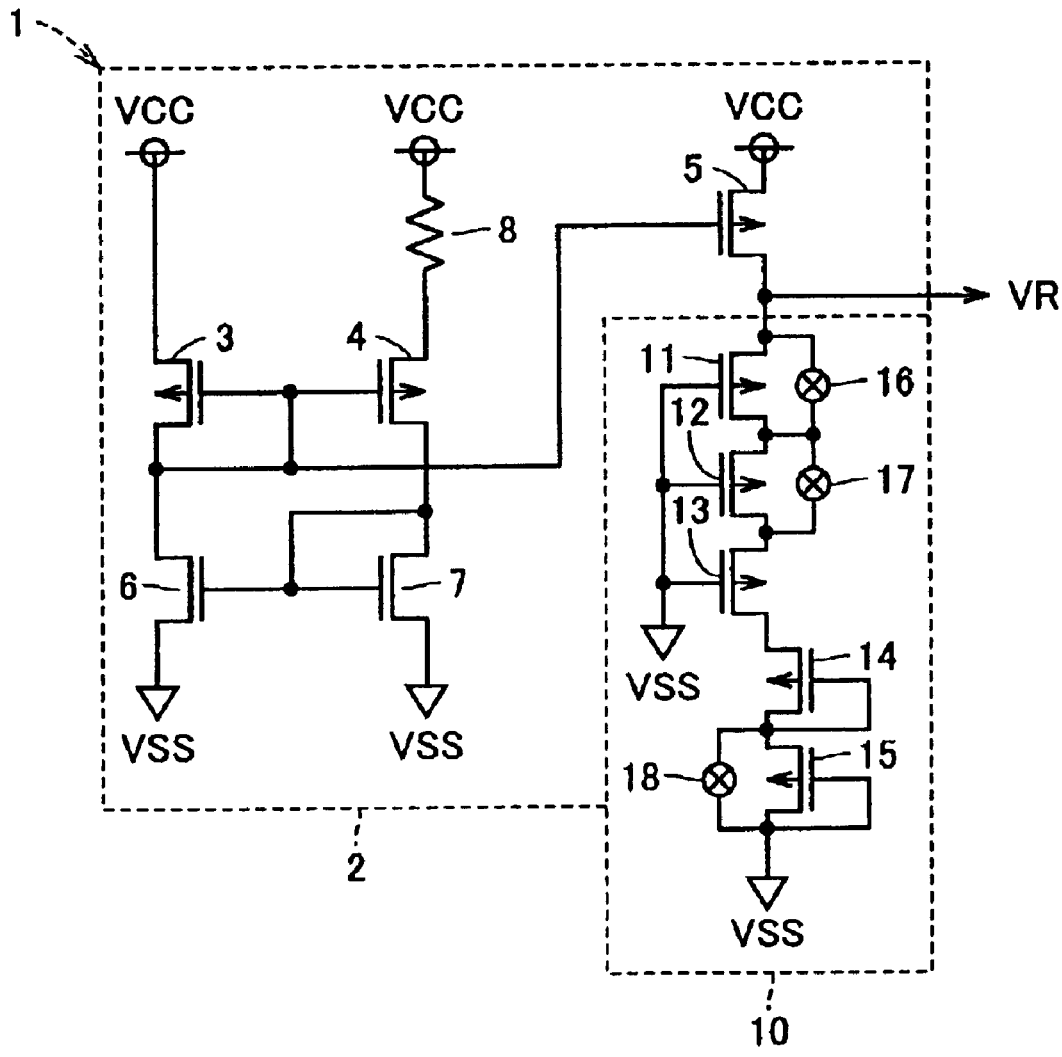
FIG. 2 shows the configuration of a reference potential generating circuit shown in FIG. 1.

Referring to FIG. 1, the internal power-supply potential generating circuit includes a reference potential generating circuit 1, a level shifter 30, a differential amplifier 35 and a P-channel MOS transistor 41. Reference potential generating circuit 1 includes, as shown in FIG. 2, a constant-current generating circuit 2 and a load circuit 10.

Constant-current generating circuit 2 includes P-channel MOS transistors 3 to 5, N-channel MOS transistors 6 and 7, and a resistive element 8. P-channel MOS transistor 3 and N-channel MOS transistor 6 are connected in series between the line of an external power-supply potential VCC and the line of a ground potential VSS. Resistive element 8, P-channel MOS transistor 4 and N-channel MOS transistor 7 are connected in series between the line of external power-supply potential VCC and the line of ground potential VSS. The gates of P-channel MOS transistors 3 and 4 are both connected to the drain of P-channel MOS transistor 3. The gates of N-channel MOS transistor 6 and 7 are both connected to the drain of N-channel MOS transistor 7. The source of P-channel MOS transistor 5 receives external power-supply potential VCC, and the gate thereof is connected to the respective gates of P-channel MOS transistors 3 and 4.

N-channel MOS transistors 6 and 7 constitute a current mirror circuit. Thus, I7/I6=W7/W6 is established, where I6 and I7 represent current flowing through N-channel MOS transistors 6 and 7 respectively, whereas W6 and W7 represent the channel widths of N-channel MOS transistors 6 and 7 respectively. Further, P-channel MOS transistors 3 and 4 operate in a weak inversion region, so that the ratio of the drain current in P-channel MOS transistor 4 to that in P-channel MOS transistor 3 is represented by the equation below.

$$\frac{I7}{I6} = \frac{W7}{W6} = \frac{AW4\exp\left\{\frac{q}{kT}(Vgs - Vr)\right\}}{AW3\exp\left(\frac{q}{kT}Vgs\right)} = \frac{W4}{W3}\exp\left(-\frac{q}{kT}Vr\right)$$

wherein W3 and W4 are the channel widths of P-channel MOS transistors 3 and 4 respectively, A is a constant, q is an elementary charge of electrons, k is a Boltzmann constant, Vgs is a gate-source voltage, and Vr is a terminal-to-terminal voltage of resistive element 8. Accordingly, constant current Ic generated at constant-current generating circuit 2 is represented by the equation below, where Ra is the resistance value of resistive element 8.

$$Ic = \frac{Vr}{Ra} = \frac{kT}{qRa}\ln\left(\frac{W4}{W3}\cdot\frac{W6}{W7}\right)$$

Load circuit 10 includes P-channel MOS transistors 11 to 15 connected in series between the drain of P-channel MOS transistor 5 and the line of ground potential VSS, and fuses 16, 17 and 18 connected in parallel with P-channel MOS transistors 11, 12 and 15, respectively. The gates of P-channel MOS transistors 11 to 13 are all connected to the line of ground potential VSS. Each of P-channel MOS transistors 11 to 13 forms a resistive element having a prescribed resistance value Rb. The gate and drain of P-channel MOS transistor 14 are connected with each other, whereas the gate and drain of P-channel MOS transistor 15 are connected with each other. Each of P-channel MOS transistors 14 and 15 forms a diode element having a prescribed threshold voltage Vth.

When fuses 16 to 18 are blown, the potential of the drain of P-channel MOS transistor 5, i.e. reference potential VR, is represented by VR=3 IcRb+2 Vth=2.2V. When fuse 17 is blown, VR=2 IcRb+2 Vth=2.0V is established. When fuses 16 to 18 are not blown, VR=IcRb+Vth=1.1V is established. Here, fuse 17 is blown to set the reference potential as VR=2.0 V.

Figure 3:
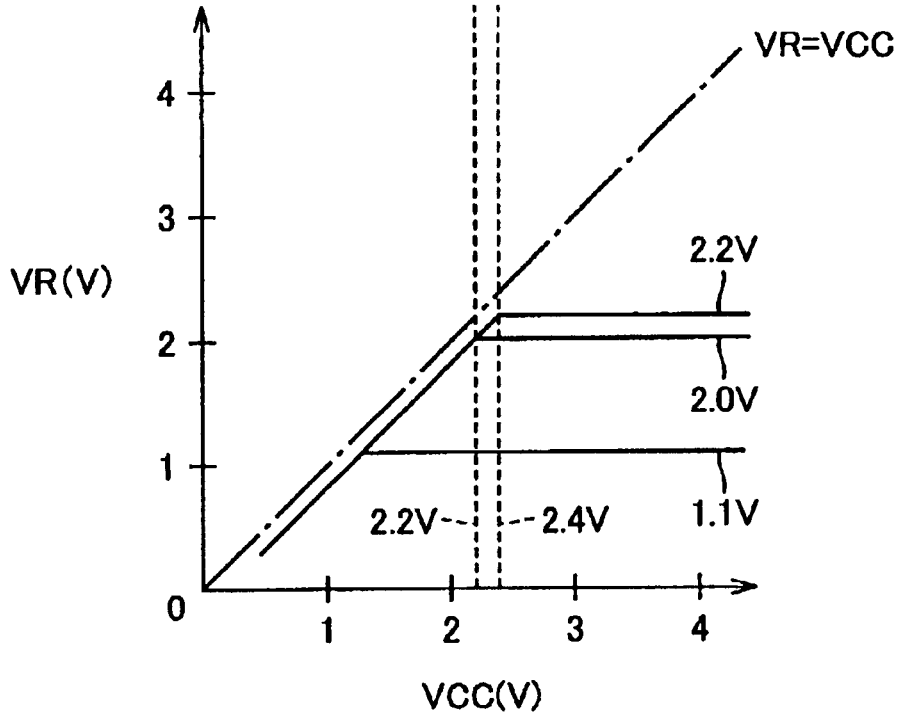
FIG. 3 shows the operation of the reference potential generating circuit shown in FIG. 2.

FIG. 3 shows a dependency of reference potential VR to external power-supply potential VCC. Referring to FIG. 3, if source-drain voltage of P-channel MOS transistor 5 is 0V, no current flows through P-channel MOS transistor 5, generating no reference potential VR. Accordingly, reference potential VR is lower than external power-supply potential VCC by the source-drain voltage of P-channel MOS transistor 5. If external power-supply potential VCC is too low, MOS transistors 3 to 7 in constant-current generating circuit 2 are brought out of conduction, generating no reference potential VR. Moreover, as described above, if external power-supply potential VCC in an appropriate range is applied, constant-current generating circuit 2 generates constant current independent of the level of external power-supply potential VCC. When fuse 17 is blown, therefore, VR=VCC−0.2V is established in the range of VCC<2.2V, and VR=2.0V is established in the range of VCC>2.2V.

Drain-source current Ids in the weak inversion region of the MOS transistor is represented by the equation below.

$$Ids = AW\exp\left(\frac{q}{kT}|Vgs|\right)$$

$$\text{Therefore, } \ln Ids = \frac{q}{kT}|Vgs| + \ln AW.$$

Figure 4:
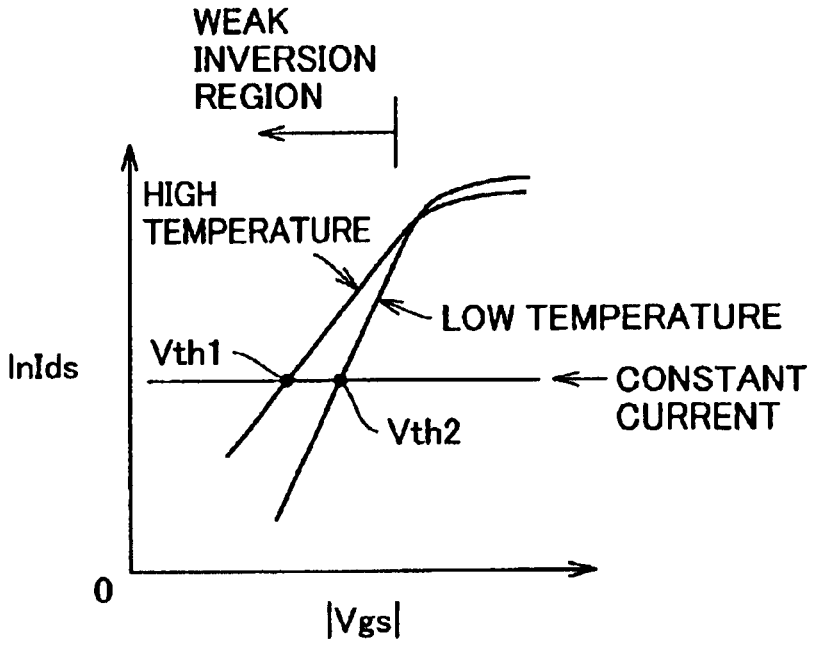
FIG. 4 illustrates the operation of a load circuit shown in FIG. 2.

FIG. 4 shows the relationship between gate-source voltage |Vgs| and drain-source current Ids in an MOS transistor. Referring to FIG. 4, the slope of the curve becomes smaller as a temperature T increases. Moreover, gate-source voltage |Vgs| obtained when constant current flows through the MOS transistor operating in the weak inversion region, i.e. threshold voltage Vth, is reduced as temperature T increases. Accordingly, the use of two MOS transistors 14 and 15 operating in the weak inversion region can cancel the positive temperature characteristic of constant-current generating circuit 2.

When fuses 16 to 18 are blown, current of the same value flows through P-channel MOS transistors 11 to 15. Assuming that, for example, each of P-channel MOS transistors 11 to 13 has a channel width W of 2 $\mu$m and a channel length L of 100 $\mu$m, and that each of P-channel MOS transistors 14 and 15 has channel width W of 8 $\mu$m and channel length L of 0.24 $\mu$m, P-channel MOS transistors 11 to 13 can be operated in an inversion region, while P-channel MOS transistors 14 and 15 can be operated in a weak inversion region.

Referring back to FIG. 1, level shifter 30 includes N-channel MOS transistors 31 to 34. N-channel MOS transistors 31 and 32 are connected between the line of external power-supply potential VCC and respective nodes N31, N32, the gates thereof receiving reference potential VR and internal power-supply potential intVCC, respectively. N-channel MOS transistors 33 and 34 are connected between respective nodes N31, N32 and the line of ground potential VSS, the gates thereof both being connected to node N31. N-channel MOS transistors 33 and 34 constitute a current mirror circuit.

Level shifter 30 is configured to have an offset voltage of 0.2V. When intVCC=VR+0.2V=2.2V, the potential of node N31 is equal to that of node N32. Thus, when the channel widths of N-channel MOS transistors 31 to 34 are represented by W31 to W34 respectively, W31/W32=W33/W34 is established in a normal level shifter, the potential of node N31 being equal to that of node N32 when VR=intVCC. In level shifter 30, however, the relationship of W31/W32>W33/W34 (e.g., W31=1.2 μm, W32=W33=W34=0.6 μm) is satistied, nodes N31 and N32 having the same potential when internal power-supply potential intVCC reaches VR+0.2V. Here, nodes N31 and N32 have a potential of 1.0V.

Differential amplifier 35 includes P-channel MOS transistors 36, 37, and N-channel MOS transistors 38 to 40. P-channel MOS transistors 36 and 37 are connected between the line of external power-supply potential VCC and respective nodes N36, N37, the gates thereof being connected to node N36. P-channel MOS transistors 36 and 37 constitute a current mirror circuit. N-channel MOS transistors 38 and 39 are connected between respective nodes N36, N37 and node N38, the gates thereof being connected to nodes N32 and N31 respectively. N-channel MOS transistor 40 is connected between node N38 and the line of ground potential VSS, the gate thereof receiving constant voltage VC. N-channel MOS transistor 40 forms a constant-current source. P-channel MOS transistor 41 is connected between the line of external power-supply potential VCC and power-supply node N41, the gate thereof being connected to node N37. The potential of power-supply node N41 comes to be internal power-supply potential intVCC.

Differential amplifer 35 is a normal differential amplifier having no offset voltage. Thus, when the channel widths of P-channel MOS transistors 36 to 39 are represented by W36 to W39 respectively, W36/W37=W38/W39 is established. P-channel MOS transistor 41 is brought out of conduction when the potential of node N32 reaches the potential of N31.

Accordingly, if internal power-supply potential intVCC is lower than VR+0.2V, the potential of node N31 is higher than the potential of node N32, making the current flowing through MOS transistors 36 to 38 smaller than the current flowing through MOS transistor 39, and thus setting node N37 at the "L" level. This brings P-channel MOS transistor 41 into conduction, so that internal power-supply potential intVCC is raised.

If internal power-supply potential intVCC is higher than VR+0.2V, the potential of node N31 is lower than the potential of node N32, making the current flowing through MOS transistors 36 to 38 greater than the current flowing through MOS transistor 39, and thus setting node N37 at the "H" level. This brings P-channel MOS transistor 41 out of conduction, so that internal power-supply potential intVCC is lowered. Hence, internal power-supply potential intVCC is held at VR+0.2V.

Figure 5:
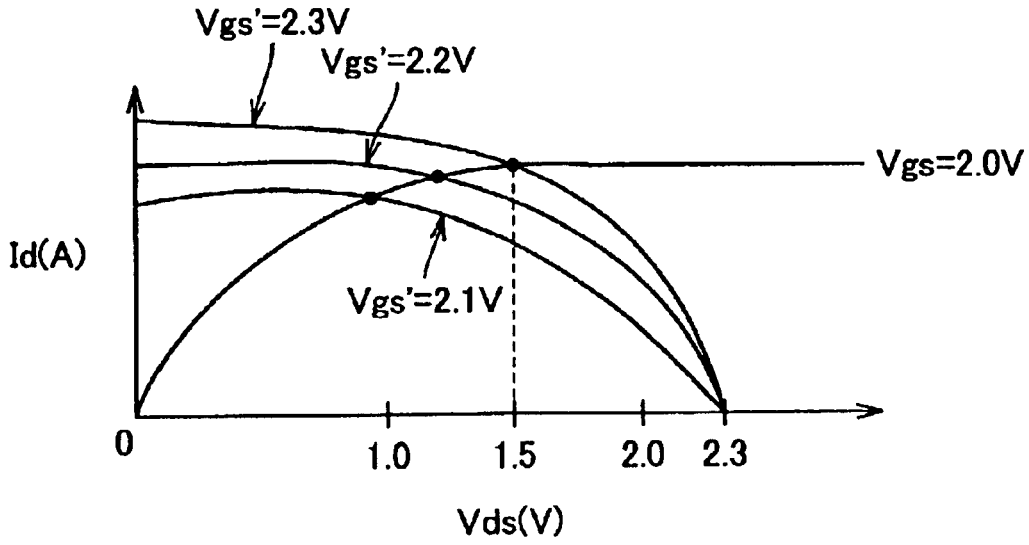
FIG. 5 illustrates the operation of a level shifter shown in FIG. 1.

FIG. 5 shows an Id-Vds characteristic of N-channel MOS transistors 38 and 39 included in differential amplifier 35 shown in FIG. 1. In FIG. 5, gate-source voltage Vgs of N-channel MOS transistor 38 is fixed at Vgs=VR=2.0V. When drain-source voltage Vds of N-channel MOS transistor 38 is raised, drain current Id of N-channel MOS transistor 38 also increases. If, however, Vds exceeds Vgs−Vth=2.3−0.8=1.5V, drain current Id comes into saturation.

The Id-Vds characteristic of N-channel MOS transistor 39 sets the point of Vds=VCC=2.3V as the origin, and sets the point of Vds=0V as the point of Vds=VCC=2.3V. When drain-source voltage Vds of N-channel MOS transistor 39 is raised while gate-source voltage Vgs' of N-channel MOS transistor 39 is set at 2.2V, drain current Id of N-channel MOS transistor 39 also increases. If Vds exceeds VCC-Vth, however, Id comes into saturation. At the intersecting point of the curve of Vgs=2.0V and the curve of Vgs'=2.2V, current Id flowing through N-channel MOS transistor 38 is equal to current Id flowing through N-channel MOS transistor 39, the potential of node N37 being Vds≐1.3V. Even if Vgs' of N-channel MOS transistor 39 varies in the range of ±0.1V from 2.2V, the potential of node N37 changes only in the range of approximately ±0.3V, resulting in a small gain of differential amplifier 20.

Figure 6:
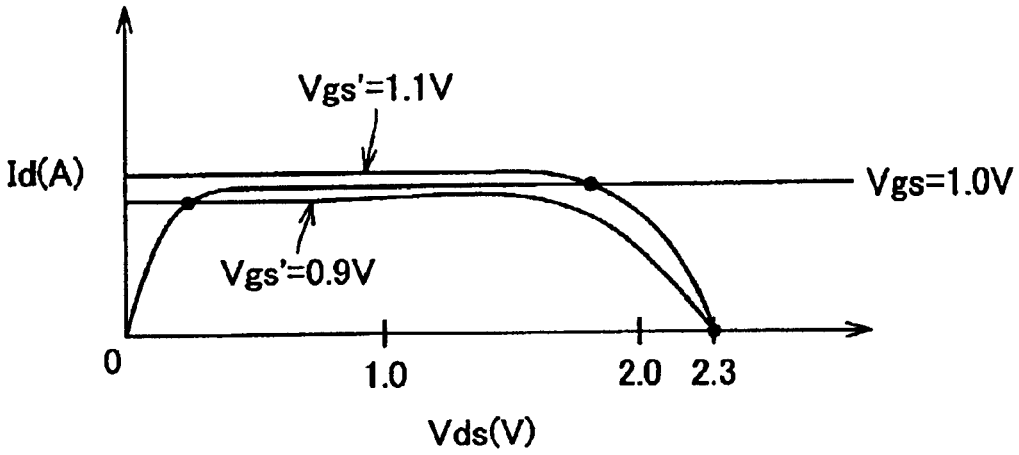
FIG. 6 is another graph illustrating the operation of the level shifter shown in FIG. 1.

According to the first embodiment, therefore, reference potential VR and internal power-supply potential intVCC are level-shifted to approximately 1.0V. This increases the area of a saturation region of the Id-Vds characteristics of N-channel MOS transistors 38 and 39, as shown in FIG. 6, widening the range of variation in the potential of node N21 to approximately 1.5V when Vgs' of N-channel MOS transistor 39 varies in the range of ±0.1V, increasing the gain of the differential amplifier.

In the first embodiment, internal power-supply potential intVCC is held at the value of potential VR+0.2V which is obtained by adding the offset voltage of level shifter 30 to reference potential VR, allowing reference potential VR to be set lower by the offset voltage. Therefore, even if external power-supply potential VCC is lowered to 2.2V, reference potential VR is held at 2.0V while internal power-supply potential intVCC is held at 2.2V.

Moreover, differential amplifier 35 is operated in a region with a large gain, improving responsivity to the variation in internal power-supply potential intVCC.

Second Embodiment

Figure 7:
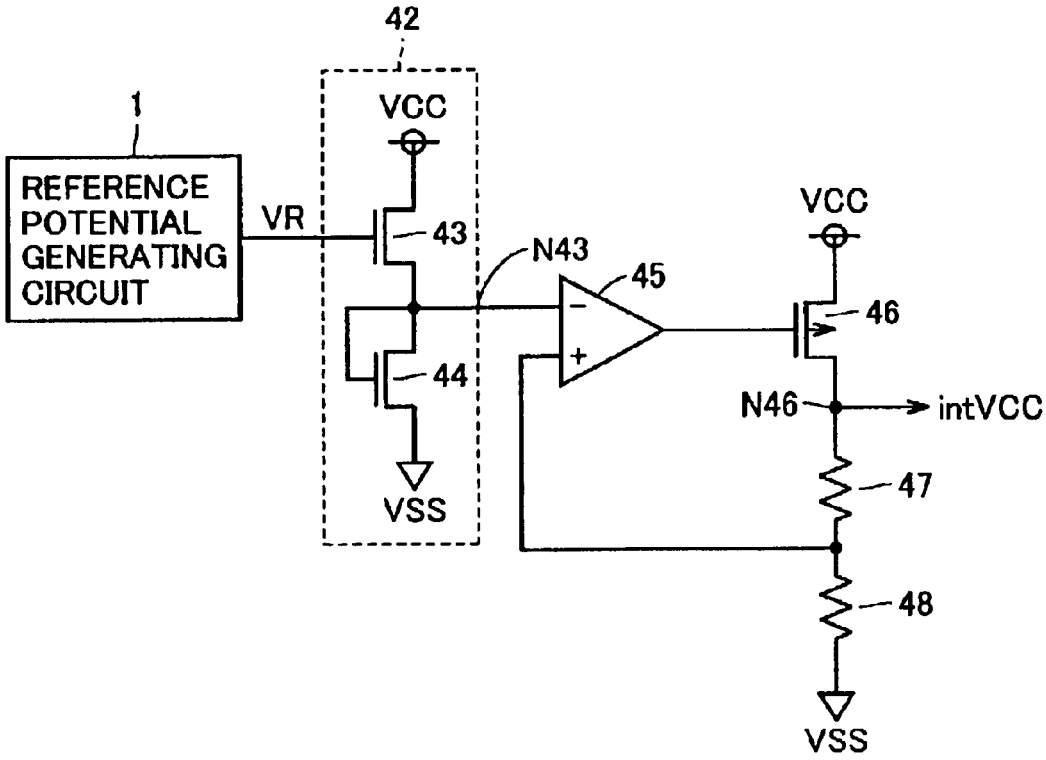
FIG. 7 is a circuit block diagram showing the configuration of an internal power-supply potential generating circuit according to the second embodiment of the present invention.
Figure 8:
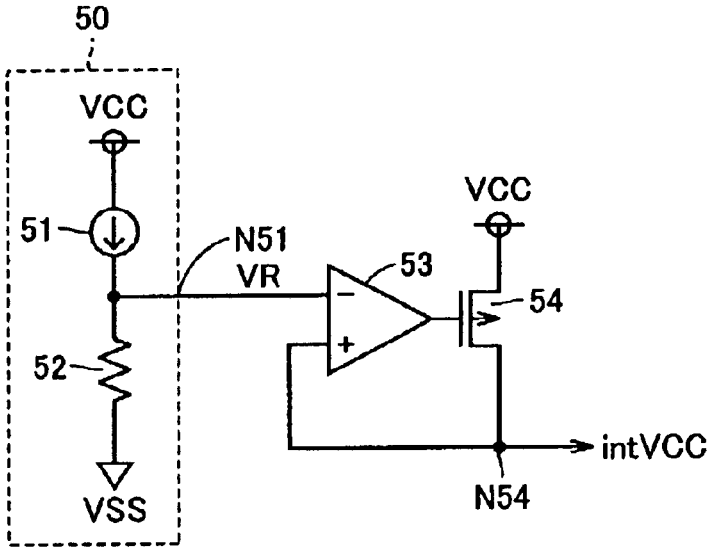
FIG.8 PRIOR ART
FIG. 8 is a circuit diagram showing the configuration of the conventional internal power-supply potential generating circuit.

FIG. 7 is a block diagram showing the configuration of an internal power-supply potential generating circuit according to the second embodiment of the present invention. Referring to FIG. 7, the internal power-supply potential generating circuit includes a reference potential generating circuit 1, a voltage dividing circuit 42, a differential amplifier 45, a P-channel MOS transistor 46, and resistive elements 47 and 48. Reference potential generating circuit 1 is the same as that shown in FIG. 2, generating a reference potential VR=2.0V that is independent of external power-supply potential VCC and a temperature T.

Voltage dividing circuit 42 includes N-channel MOS transistors 43 and 44 connected in series between the line of external power-supply potential VCC and the line of ground potential VSS. N-channel MOS transistor 43 has its gate receiving reference potential VR, and its drain (node N43) connected to the gate of N-channel MOS transistor 44. When the channel widths of N-channel MOS transistors 43 and 44 are represented by W43 and W44 respectively, the channel widths are set as W43>W44 such that node N43 of 1.1V is obtained. It is noted that, when W43=W44, the potential of node N43 is represented by VR/2=1.0V.

P-channel MOS transistor 46 is connected between the line of external power-supply potential VCC and power-supply node N46. The potential of power-supply node N36 comes to be internal power-supply potential intVCC. Resistive elements 47 and 48 are connected in series between power-supply node N46 and the line of ground potential VSS. Resistive elements 47 and 48 have the same resistance value.

Differential amplifier 45 has an inverting input terminal that receives an output potential of voltage dividing circuit 42, a noninverting input terminal connected to the node between resistive elements 47 and 48, and an output terminal connected to the gate of P-channel MOS transistor 46. Differential amplifier 45 controls the gate potential of P-channel MOS transistor 46 such that the potential of the node between resistive elements 47 and 48 corresponds with the output potential of voltage dividing circuit 42. Thus, internal power-supply potential intVCC is held at 2.2V.

According to the second embodiment, a potential intVCC/2 obtained by dividing internal power-supply potential intVCC by 2 is held at a potential of 1.1VR/2=1.1V obtained by dividing reference potential VR of 1.1 by 2, allowing reference potential VR to be set at 2.0V. Therefore, even if internal power-supply potential VCC is lowered to 2.2V, reference potential VR is held at 2.0V, while internal power-supply potential intVCC is held at 2.2V.

Note that, when fuses 16 to 18 in FIG. 2 are not blown to set reference potential VR at 1.1V and this reference potential VR of 1.1V is applied to the inverting input terminal of differential amplifier 45 by eliminating voltage dividing circuit 42 in FIG. 7, internal power-supply potential intVCC is greatly raised as the temperature increases. This is because two diode elements (P-channel MOS transistors 14, 15) having a negative temperature characteristic is required, i.e., one diode element (P-channel MOS transistor 14) is insufficient, in order to cancel the positive temperature characteristic of constant-current generating circuit 2. It is, therefore, required to set reference potential VR at 2.2V by blowing fuses 16 to 18 and to provide voltage dividing circuit 42 in order to stabilize internal power-supply potential intVCC.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal power-supply potential generating circuit generating an internal power-supply potential based on an external power-supply potential, comprising:

a switching element connected between a line of said external power-supply potential and a line of said internal power-supply potential;

a reference potential generating circuit generating a predetermined first reference potential;

a level shift circuit having a predetermined offset voltage and generating a second reference potential lower than said first reference potential by a predetermined voltage while generating a monitoring potential lower than said internal power-supply potential by a voltage obtained by adding said offset voltage to said predetermined voltage; and a differential amplifier bringing said switching element into conduction when said monitoring potential is lower than said second reference potential, and bringing said switching element out of conduction when said monitoring potential is higher than said second reference potential.

2. The internal power-supply potential generating circuit according to claim 1, wherein said level shift circuit includes first and second transistors connected between the line of the external power-supply potential and first and second nodes respectively, and having input electrodes that receive said first reference potential and said internal power-supply potential respectively, and third and fourth transistors connected between a line of a ground potential and said first and second nodes respectively, and having respective input electrodes both connected to said second node;

said second reference potential and said monitoring potential are potentials at said first and second nodes respectively; and a ratio of current drivability of said first transistor to current drivability of said second transistor is greater than a ratio of current drivability of said third transistor to current drivability of said fourth transistor.

3. An internal power-supply potential generating circuit generating an internal power-supply potential based on an external power-supply potential, comprising:

a switching element connected between a line of said external power-supply potential and a line of said internal power-supply potential;

a first voltage dividing circuit having a first voltage division ratio and generating a monitoring potential by dividing said internal power-supply potential;

a reference potential generating circuit generating a predetermined first reference potential;

a second voltage dividing circuit having a second voltage division ratio higher than said first voltage division ratio, and generating a second reference potential by dividing said first reference potential; and a differential amplifier bringing said switching element into conduction when said monitoring potential is lower than said second reference potential, and bringing said switching element out of conduction when said monitoring potential is higher than said second reference potential.

4. The internal power-supply potential generating circuit according to claim 3, wherein said second voltage dividing circuit includes a first transistor connected between the line of said external power-supply potential and an output node, and having an input electrode that receives said first reference potential, and a second transistor having a first electrode and an input electrode connected to said output node and a second electrode connected to a line of a ground potential; and said second reference potential is a potential of said output node.

5. The internal power-supply potential generating circuit according to claim 3, wherein said reference potential generating circuit includes a constant-current generating circuit generating constant current of a predetermined value, and a load circuit generating said first reference potential based on the constant current generated at said constant-current generating circuit; and said constant-current generating circuit and said load circuit are configured such that one temperature characteristic compensates the other temperature characteristic.

* * * * *